United States Patent [19]

Glass et al.

[11] Patent Number: 4,602,490

[45] Date of Patent: Jul. 29, 1986

[54] LATCHING DEVICE WITH ADJUSTABLE BACKSET

[75] Inventors: Dwight W. Glass, Rockford, Ill.; Phillip D. Stinson, Sikeston, Mo.

[73] Assignee: Amerock Corporation, Rockford, Ill.

[21] Appl. No.: 727,854

[22] Filed: Apr. 26, 1985

[51] Int. Cl.[4] ..... E05B 9/04

[52] U.S. Cl. ..... 70/134; 70/379 R; 70/448; 70/461; 292/1; 292/169; 292/337; 292/DIG. 60

[58] Field of Search ..... 70/134, 143, 379 A, 70/379 R, 380, 448, 461; 292/169, 169.23, 1, 337, DIG. 44, DIG. 60

[56] References Cited

U.S. PATENT DOCUMENTS

| | | | |
|---|---|---|---|
| 40,875 | 12/1863 | Williams | 292/DIG. 60 X |
| 4,248,068 | 2/1981 | Esser et al. | 70/134 |
| 4,372,594 | 2/1983 | Gater | 292/337 |
| 4,427,224 | 1/1984 | Bergen | 292/169.23 |
| 4,446,707 | 5/1984 | Mullick | 70/134 |

OTHER PUBLICATIONS

*Locksmith Ledger*, May 1984, pp. 80 and 81.

*Primary Examiner*—Robert L. Wolfe
*Assistant Examiner*—Lloyd A. Gall
*Attorney, Agent, or Firm*—Leydig, Voit & Mayer

[57] ABSTRACT

The backset of a deadbolt lock may be adjusted selectively between $2\frac{3}{8}''$ and $2\frac{3}{4}''$ by manually shifting a spring-loaded pin which extends through vertical slots in the lock bolt, U-shaped slots in the driver bar and inverted L-shaped slots in the lock case. The pin also connects the driver bar to the bolt and causes the bolt to move between extended and retracted positions when the operating spindle of the lock is turned.

11 Claims, 8 Drawing Figures

LATCHING DEVICE WITH ADJUSTABLE BACKSET

BACKGROUND OF THE INVENTION

This invention relates to a latching device and, more particularly, to a latching device having an adjustable backset enabling the latching device to be installed in different types of doors.

Locks with adjustable backsets are disclosed in Gater U.S. Pat. No. 4,372,594 and Bergen U.S. Pat. No. 4,427,224. Weslock Division of TRE Corporation also makes and sells a deadbolt lock with an adjustable backset.

SUMMARY OF THE INVENTION

The general aim of the present invention is to provide a new and improved adjustable backset latching device which is simpler in construction than prior devices of the same general type and which, at the same time, may be adjusted in an easier and more foolproof manner.

A more detailed object of the invention is to achieve the foregoing by providing a latching device in which the latching bolt is coupled to a driver bar by a pin which normally connects the bolt and the driver bar for longitudinal reciprocation in unison but which may be shifted to permit the driver bar to be moved longitudinally relative to the bolt and thereby enable adjustment of the backset.

Still another object is to provide a latching device in which a single pin serves both as a drive pin for the bolt and as an adjustment pin for enabling changing of the backset.

A further object of the invention is to provide a latching device whose components are uniquely slotted to enable the latching device to be converted from one with a permanent backset to one with an adjustable backset with the addition of nothing more than a simple spring.

These and other objects and advantages of the invention will become more apparent from the following detailed description when taken in conjunction with the accompanying drawings.

DETAILED DESCRIPTION OF THE PREFERRED EMBODIMENT

Figure 5:
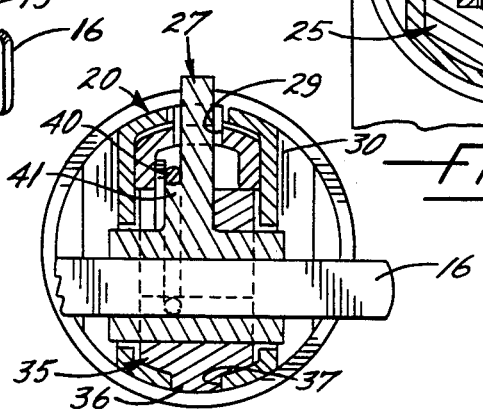

For purposes of illustration, the invention has been shown in the drawings as incorporated in a latching device in the form of a deadbolt lock 10 for locking a door 11. The lock includes the usual inner and outer escutcheons 12 and 13 located on the inner and outer sides of the door and supporting a turn button 14 and a lock cylinder 15, respectively. The door is adapted to be locked and unlocked either by turning the button or by turning an appropriate key 16 adapted to be inserted into the cylinder. Turning of either the button or the key results in turning of an operator spindle 16 (FIGS. 2 and 5) which extends between the two escutcheons by way of a circular hole formed through the door. Two screws 18 (FIG. 2) also extend through the door hole and connect the escutcheons to one another.

Figure 1:
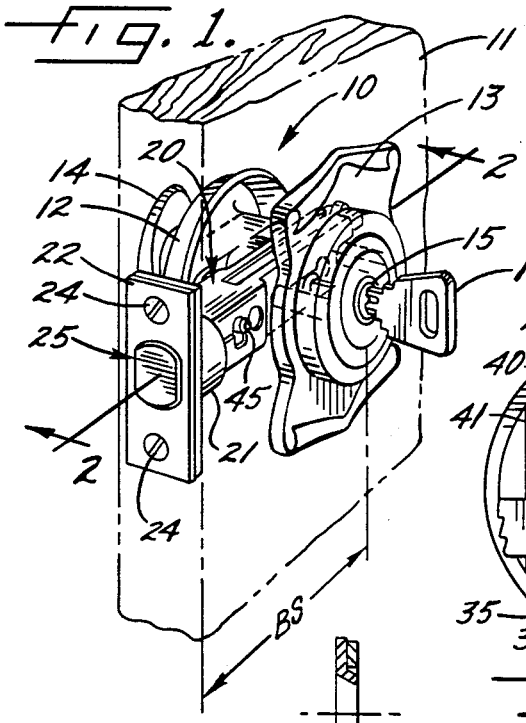
FIG. 1 is a fragmentary perspective view of a door equipped with a new and improved latching device incorporating the unique features of the present invention.

A blind bore is formed in the edge of the door 11 and receives an elongated tubular case 20. Fitted over the outer end portion of the case is a face plate adaptor 21 which serves as a backing for a face plate 22 (FIG. 1) located at the edge of the door. Screws 24 extend through the face plate and the adaptor to secure those elements to the door. The face plate is located in a mortised recess in the edge of the door and thus the outer side of the face plate lies flush with the edge of the door.

Figure 8:
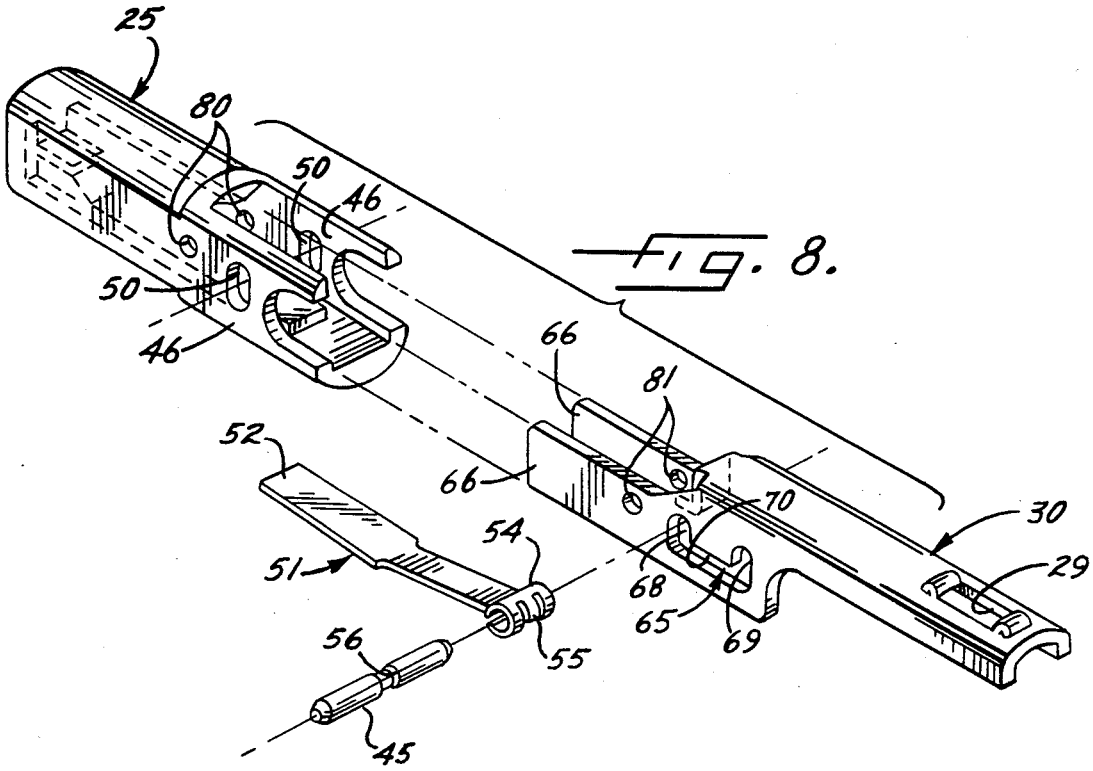
FIG. 8 is an exploded perspective view of certain parts of the latching device.

Slidable longitudinally back and forth within the case 20 between an inwardly retracted position (FIG. 2) and an outwardly extended position (FIG. 3) is an elongated deadbolt 25 which carries a hardened security pin 26. The bolt is adapted to be moved longitudinally in response to turning of the operator spindle 16. For this purpose, a dog 27 (FIGS. 2 and 5) is secured to and projects radially from the spindle 16 and extends into an elongated slot 29 (see FIG. 8) formed in the upper side of an elongated driver bar 30 adjacent the inner end thereof. The driver bar is slidable longitudinally within the case 20 and its outer end portion is connected to the bolt 25. When the spindle 16 is turned in one direction, the upper end portion of the dog 27 engages the outer end of the slot 29 and pushes the driver bar outwardly to extend the bolt from the position shown in FIG. 2 to the position shown in FIG. 3. Turning of the spindle in the opposite direction causes the upper end portion of the dog to push against the inner end of the slot 29 and thereby retract the driver bar and the bolt inwardly.

The dog 27 is rotatably supported within a cradle-like slide 35 (FIGS. 2 and 5) whose lower end portion is formed with a tongue 36 projecting into an elongated slot 37 formed in the bottom of the case 20. The slide is held within the case by the screws 18, the latter extending through ears 39 formed at the ends of the slide. A wire spring 40 (FIG. 2) is hooked around the ears and bears against a shoulder 41 formed on one side of the dog 27 about midway along the length thereof. The spring works against the dog with an overcenter action to hold the dog releasably in each of its positions shown in FIGS. 2 and 3 and to cause the dog to snap to each position when the spindle 16 is turned. As a result, final movement of the bolt 25 to its extended and retracted positions is with a snap action.

Figure 2:
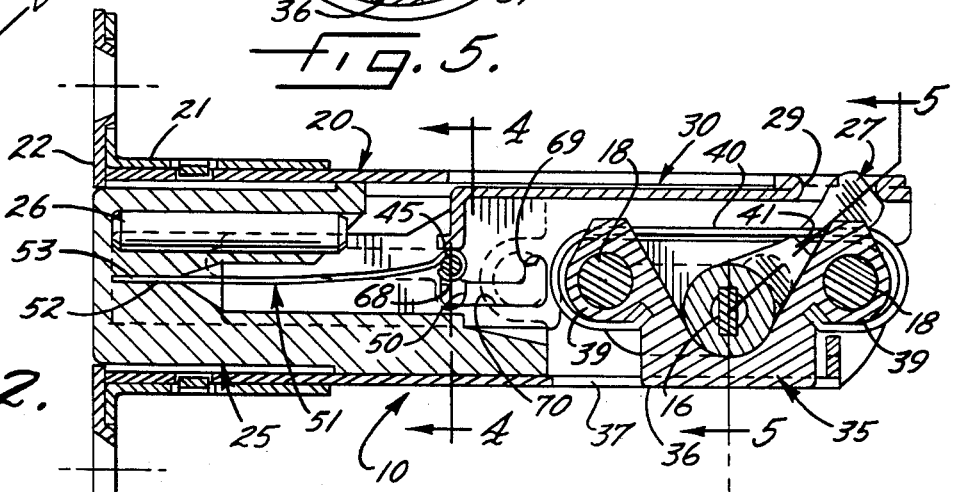
FIG. 2 is an enlarged fragmentary cross-section taken substantially along the line 2—2 of FIG. 1 and shows the latching device adjusted to a $2\frac{3}{4}''$ backset, the latching bolt being illustrated in a retracted position.
Figure 3:
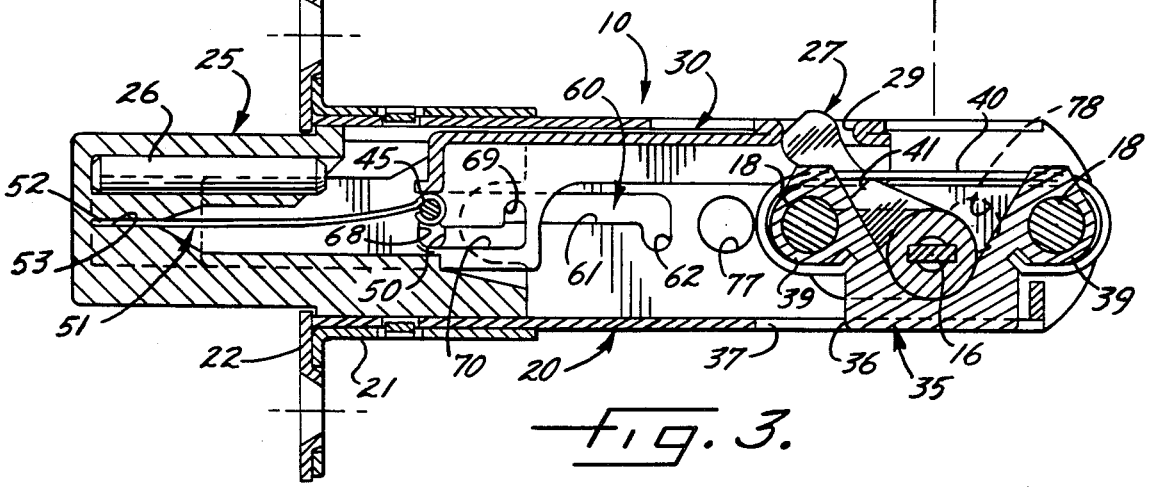
FIG. 3 is a view similar to FIG. 2 but shows the latching bolt in extended position.

As shown in FIG. 2, the rotational axis of the spindle 16 is spaced longitudinally from the outer side of the face plate 22 by a predetermined backset distance which has been indicated as BS. Basically, the backset distance may be considered to be the distance between the edge of the door 11 and the circular hole through the door. Most doors either have a backset of $2\frac{3}{4}''$ or a backset of $2\frac{3}{8}''$. In FIGS. 2 and 3, the lock 10 is shown as ready for installation in a door with a backset BS of $2\frac{3}{4}''$. In FIGS.

6 and 7, the lock has been adjusted to a backset BS' of $2\frac{3}{8}''$. Locks which are adjustable to different backsets have been known in the art as exemplified by the patents identified above.

In accordance with the present invention, various components of the lock 10 are coupled by a unique pin-and-slot connection which enables both the driver bar 30 and the slide 35 to be adjusted longitudinally relative to the case 20 and the bolt 25 and thereby permit adjustment of the backset. As will become more apparent subsequently, the novel pin-and-slot connection of the invention enables the lock 10 to be made of the adjustable backset type in a relatively simple and inexpensive manner and enables the adjustment to be made quickly and reliably.

Figure 4:
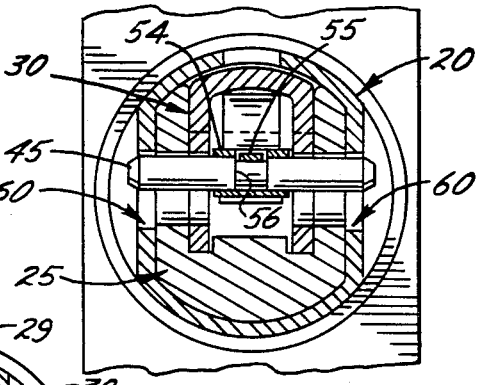
FIGS. 4 and 5 are enlarged fragmentary cross-sections taken substantially along the lines 4—4 and 5—5, respectively of FIG. 2.

More specifically, the pin-and-slot connection includes a floating pin 45 which extends transversely through the case 20, the bolt 25 and the driver bar 30. As shown most clearly in FIG. 8, the inner end portion of the bolt 25 is hollowed out so as to define two transversely spaced wings 46. Vertically elongated slots 50 are formed through the wings and receive the floating pin 45 with the pin normally seating against the upper ends of such slots. To keep the pin seated against the upper ends of the slots 50, an elongated leaf spring 51 acts between the bolt and the pin. Herein, one end portion of the spring is formed with a tang 52 (FIG. 8) which is received in a slot 53 (FIG. 2) formed inside of the bolt 25 near the outer end thereof. A curl 54 (FIG. 8) on the opposite end portion of the spring extends around the pin. The center knuckle 55 of the curl is bent into an annular groove 56 formed around the center portion of the pin and captivates the pin against axial movement relative to the curl (see FIG. 4). The spring is bowed upwardly as shown in FIG. 2 and acts to urge the pin 45 upwardly against the upper ends of the slots 50.

When the bolt 25 is shifted between its extended and retracted positions, the pin 45 travels in slots 60 (FIGS. 3 and 4) formed in the sides of the case 20. Herein, each of the slots 60 is of an inverted L-shaped configuration and includes a relatively long longitudinally extending portion 61 (FIG. 3). Located at the inner end of each longitudinally extending portion 61 is a downwardly extending slot portion 62 which defines a relatively short leg. The pin normally travels back and forth in the longitudinally extending slot portions 61 during retraction and extension of the bolt 25 (compare FIGS. 2 and 3) and normally is prevented from entering the downwardly extending leg portions 62 by virtue of the spring 51 urging the pin upwardly.

In carrying out the invention, the driver bar 30 includes slot means which receive the pin 45 to connect the driver bar to the bolt 25 and which, in addition, permit the pin to be shifted to a position enabling longitudinal adjustment of the driver bar relative to the bolt for the purpose of adjusting the backset. In the present instance, such slot means comprise a pair of identical U-shaped slots 65 (FIG. 8) formed through transversely spaced side plates 66. The latter define the outer end portion of the driver bar 30 and extend into the inner end portion of the bolt 25 between the wings 46 thereof.

Each of the U-shaped slots 65 of the driver bar 30 includes two longitudinally spaced slot portions 68 and 69 (FIG. 8) which extend upwardly and define legs. Located at the lower ends of each set of legs 68 and 69 and extending between the two is a longitudinally extending bridge slot portion 70. Each longitudinally extending bridge portion 70 is offset downwardly from the longitudinally extending portion 61 of the slot 60 in the case 20 (see FIG. 3).

When the lock 10 is set up for a $2\frac{3}{4}''$ backset BS as shown in FIGS. 2 and 3, the legs 68 of the U-shaped slots 65 are positioned in longitudinal alinement with the slots 50 in the bolt 25 and receive the pin 45. The spring 51 normally urges the pin upwardly to hold the pin upwardly in the legs 68 and to prevent the pin from entering the longitudinal bridge portions 70 of the slots 65. Thus, when the driver bar 30 is extended and retracted by the dog 27, the driver bar acts through the pin to extend and retract the bolt 25 (compare FIGS. 2 and 3).

To convert the lock 10 to a $2\frac{3}{8}''$ backset BS', the screws 18 are removed from the slide 35 and from holes 75 and 76 (FIG. 6) in the case 20 to free the slide relative to the case. With the bolt 25 in its retracted position, the pin 45 is manually pushed downwardly within the legs 62 of the L-shaped slots 60 in the case 20 and within the legs 68 of the U-shaped slots 65 in the driver bar 30 and into vertical alinement with the longitudinally extending bridge portions 70 of the slots 65. Such downward movement of the pin 45 frees the driver bar 30 for outward movement relative to the bolt 25 and the pin when the slide 35 is manually pushed outwardly. The slide pushes against the driver bar and shoves the latter toward the position shown in FIG. 6. The edges of the slot portions 70 slide along the pin during such movement and, in addition, the tongue 36 slides within the slot 37.

Figure 6:
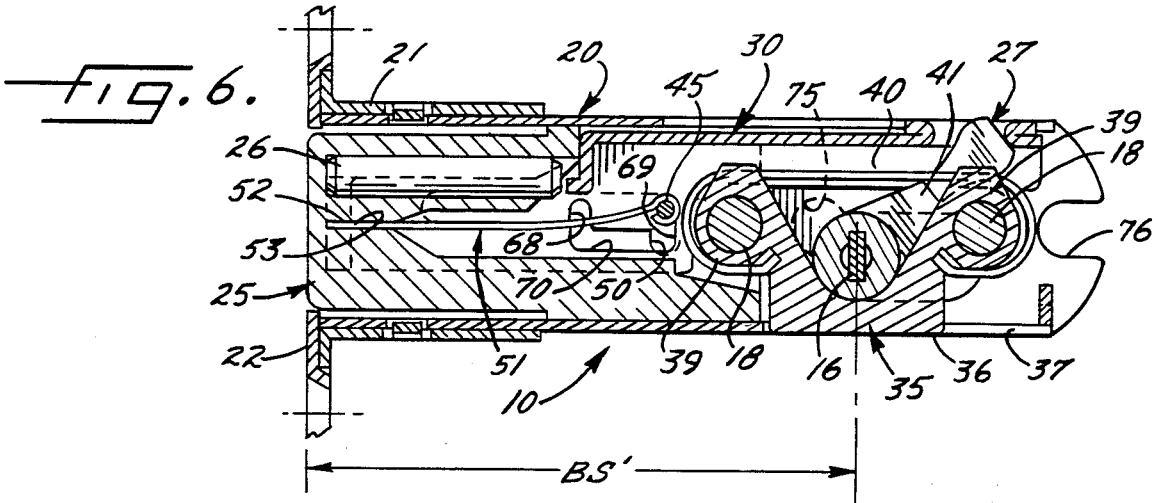
FIGS. 6 and 7 are views similar to FIGS. 2 and 3, respectively, but show the latching device adjusted to a $2\frac{3}{8}''$ backset.
Figure 7:
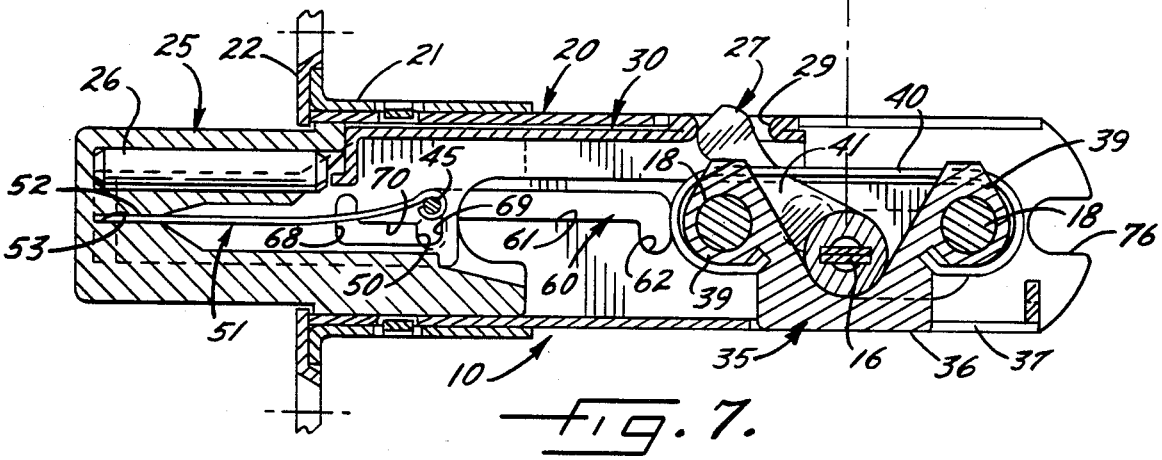

When the driver bar 30 reaches the shortened backset position shown in FIGS. 6 and 7, the legs 69 of the U-shaped slots 65 in the driver bar are alined longitudinally with the legs 62 of the slots 60 in the case 20. Accordingly, when the pin 45 is manually released, the spring 51 snaps the pin upwardly into the legs 69 and out of vertical alinement with the bridge portions 70 to lock the driver bar 30 to the bolt 25 and thereby hold the driver bar at its adjusted $2\frac{3}{8}''$ backset BS'. The screws 18 then may be inserted through the holes 77 and 78 (FIG. 3) in the case 20 and inserted through the ears 39 of the slide to secure the slide to the case.

Re-adjustment of the lock 10 to the $2\frac{3}{4}''$ backset BS (FIGS. 2 and 3) is accomplished simply by pushing the pin 45 downwardly and pulling the slide 35 inwardly. During such pulling, the dog 27 acts against the inner end of the slot 29 to pull the driver bar 30 inwardly until the legs 68 of the slots 65 in the driver bar are alined longitudinally with the legs 62 of the slots 60 in the case 20. Upon release of the pin, the spring 51 snaps the pin into the upper ends of the legs 68 to prevent movement of the driver bar relative to the bolt 25 during normal extension and retraction of the bolt.

At the option of the lock manufacturer, the lock 10 may be permanently set at either the $2\frac{3}{4}''$ backset BS or the $2\frac{3}{8}''$ backset BS'. For this purpose, circular holes 80 and 81 (FIG. 8) are formed through the bolt 25 and the driver bar 30, respectively. To establish a permanent $2\frac{3}{4}''$0 backset BS, the pin 45 is simply assembled permanently through the holes 80 and 81 by the lock manufacturer, the spring 51 being omitted. A permanent $2\frac{3}{8}''$ backset BS' may be established by assembling the pin through the hole 80 and the legs 68 of the slots 65.

From the foregoing, it will be apparent that the same pin 45 serves both as a drive pin and as an adjustment pin to permit the driver bar 30 and the slide 35 to be adjusted longitudinally relative to the case 20 and the bolt 25. The adjustment may be effected simply by pushing the pin downwardly, moving the slide longitudinally and then allowing the pin to spring upwardly. By virtue of the unique slot construction, the only additional part required to make a permanent backset lock to be of the adjustable backset type is the spring 51. Thus, the adjustable lock may be manufactured in a relatively inexpensive manner.

We claim:

1. A door latch having an elongated stationary case, a bolt mounted to reciprocate longitudinally in said case between outwardly extended and inwardly retracted positions, an operator rotatable about an axis extending transversely through said case, a driver connected between said operator and said bolt and operable to move said bolt longitudinally in response to rotation of said operator, the longitudinal distance between said axis and the outer end of said case constituting the backset of the latch, and means enabling the backset of said latch to be adjusted, said latch being characterized in that said means comprise slots formed in said case, said bolt and said driver, a pin extending through said slots and normally disposed in a drive position connecting said driver to said bolt and causing said bolt to move longitudinally between said extended and retracted positions in response to rotation of said operator, said pin being movable manually within all of said slots to an adjustment position freeing said operator and said driver for adjustment longitudinally relative to said case and said bolt and thereby enable adjustment of said backset.

2. A door latch having an elongated stationary case, a bolt mounted to reciprocate longitudinally in said case between outwardly extended and inwardly retracted positions, an operator rotatable about an axis extending transversely through said case, a driver connected between said operator and said bolt and operable to move said bolt longitudinally in response to rotation of said operator, the longitudinal distance between said axis and the outer end of said case constituting the backset of the latch, and means enabling the backset of said latch to be adjusted, said latch being characterized in that said means comprise slots in said bolt, said case and said driver, the slot in said bolt extending vertically, the slots in said case and said driver each having a longitudinally extending portion and each having a vertically extending leg at one end of the longitudinally extending portion, the slot in said driver having an additional leg located at the other end of its longitudinally extending portion, the longitudinally extending portions of the slots in said case and said driver being offset vertically from one another, a pin extending through the slot in said bolt and normally extending through the longitudinally extending portion of the slot in said case, said pin normally being alined vertically with and normally being movable back and forth within the longitudinally extending portion of the slot in said case to permit said bolt to reciprocate between its extended and retracted positions, said pin normally being misalined vertically with the longitudinally extending portion of the slot in said driver and normally extending through one of the vertical legs of the slot in said driver to connect said driver to said bolt and cause said bolt to move longitudinally between said extended and retracted positions in response to rotation of said operator, and said pin being manually movable vertically in the slot in said bolt, in the vertical leg of the slot in said case and in the vertical legs of the slot in said driver and into vertical alinement with the longitudinally extending portion of the slot in said driver to permit said driver and said operator to be adjusted longitudinally relative to said bolt and said case and thereby change said backset.

3. A door latch as defined in claim 2 in which the slot in said driver is U-shaped.

4. A door latch as defined in claim 3 in which the legs of the slot in said driver project in one direction from the longitudinally extending portion of such slot, the leg of the slot in said case projecting in the opposite direction from the longitudinally extending portion of the latter slot.

5. A door latch as defined in claim 2 further including resiliently yieldable means urging said pin into the legs of the slot in said driver and out of alinement with the longitudinally extending portion of the slot in said driver.

6. A door latch as defined in claim 5 in which said resiliently yieldable means comprise a leaf spring having one end portion acting against said bolt and an opposite end portion acting against said pin.

7. A door latch as defined in claim 2 further including holes in said bolt and said driver and adapted optionally to receive said pin to establish a fixed backset.

8. A door latch having an elongated stationary case, a bolt mounted to reciprocate longitudinally in said case between outwardly extended and inwardly retracted positions, an operator rotatable about an axis extending transversely through said case, a driver connected between said operator and said bolt and operable to move said bolt longitudinally in response to rotation of said operator, the longitudinal distance between said axis and the outer end of said case constituting the backset of the latch, and means enabling the backset of said latch to be adjusted, said latch being characterized in that said means comprise a vertical slot in said bolt, a U-shaped slot in said driver and having longitudinally spaced vertical leg portions located at the ends of a longitudinally extending bridge portion, a slot in said case and having a vertical leg portion located at the end of a longitudinally extending portion, the vertical leg portions of the U-shaped slot in said driver projecting oppositely with respect to the vertical leg portion of the slot in said case, the U-shaped slot in said driver being located such that its longitudinally extending bridge portion is offset vertically from the longitudinally extending portion of the slot in said case, a pin extending through the slot in said bolt and normally extending through the longitudinally extending portion of the slot in said case, said pin normally being movable back and forth within the longitudinally extending portion of the slot in said case to permit said bolt to reciprocate between its extended and retracted positions, said pin normally extending through one of the vertical leg portions of the slot in said driver to connect said driver to said bolt and cause said bolt to move longitudinally between said extended and retracted positions in response to rotation of said operator, and said pin being manually movable vertically in one direction in the slot in said bolt, in the vertical leg portion of the slot in said case and in said one vertical leg portion of the slot in said driver and into vertical alinement with the bridge portion of the slot in said driver to permit said driver and said operator to be shifted longitudinally relative to said bolt and said case and thereby adjust said backset, said pin thereafter being movable vertically in the other direction in the slot in said bolt, in the vertical leg portion of the slot in said case, and in the other vertical leg portion of the slot in said driver and out of vertical alinement with the bridge portion of the slot in said driver thereby to fix said driver and said operator longitudinally relative to said bolt and said case and maintain the adjusted backset.

9. A latch as defined in claim 8 further including resiliently yieldable means urging said pin in said other direction in said slots.

10. A latch as defined in claim 9 in which said resiliently yieldable means comprise a leaf spring having one end portion acting against said bolt and an opposite end portion acting against said pin.

11. A door latch having an elongated stationary case, a bolt mounted to reciprocate longitudinally in said case between outwardly extended and inwardly retracted positions, an operator rotatable about an axis extending transversely through said case, a driver connected between said operator and said bolt and operable to move said bolt longitudinally in response to rotation of said operator, the longitudinal distance between said axis and the outer end of said case constituting the backset of the latch, and means enabling the backset of said latch to be adjusted, said latch being characterized in that said means comprise vertical slot means in said bolt, U-shaped slot means in said driver and having longitudinally spaced vertical leg means located at the ends of longitudinally extending bridge means, slot means in said case and having vertical leg means located at the ends of longitudinally extending means, the vertical leg means of the U-shaped slot means in said driver projecting oppositely with respect to the vertical leg means of the slot means in said case, the U-shaped slot means in said driver being located such that its longitudinally extending bridge means is offset vertically from the longitudinally extending means of the slot means in said case, a pin extending through the slot means in said bolt and normally extending through the longitudinally extending means of the slot means in said case, said pin normally being movable back and forth within the longitudinally extending means of the slot means in said case to permit said bolt to reciprocate between its extended and retracted positions, said pin normally extending through one of the vertical leg means of the slot means in said driver to connect said driver to said bolt and cause said bolt to move longitudinally between said extended and retracted positions in response to rotation of said operator, and said pin being manually movable vertically in the slot means in said bolt, in the vertical leg means of the slot means in said case and in the vertical leg means of the slot means in said driver and into vertical alinement with the bridge means of the slot means in said driver to permit said driver and said operator to be adjusted longitudinally relative to said bolt and said case and thereby change said backset.

* * * * *